United States Patent [19]

Frost et al.

[11] Patent Number: 4,556,786

[45] Date of Patent: Dec. 3, 1985

[54] HEATING APPARATUS

[75] Inventors: Kenneth S. Frost, Broxbourne; Alex L. Halberstadt, London; John A. Letchford, Enfield, all of England

[73] Assignee: Thorn EMI Domestic Appliances Limited, London, England

[21] Appl. No.: 620,842

[22] Filed: Jun. 15, 1984

[30] Foreign Application Priority Data

Jun. 15, 1983 [GB] United Kingdom ..... 8316304

[51] Int. Cl.[4] ..... H05B 3/68

[52] U.S. Cl. ..... 219/464; 219/352; 219/460; 219/462; 219/468; 219/530; 219/540; 313/315

[58] Field of Search ..... 219/343, 348, 349, 350, 219/351, 352, 354, 388, 405, 411, 458, 459, 460, 461, 462, 463, 464, 466, 467, 530, 540, 553; 313/315, 331, 332, 381

[56] References Cited

U.S. PATENT DOCUMENTS

| | | | |
|---|---|---|---|
| 2,601,011 | 6/1952 | Wilcox | 219/461 |
| 2,859,368 | 11/1958 | Biggs et al. | 219/553 X |
| 2,954,826 | 10/1960 | Sievers | 219/553 X |
| 2,988,634 | 6/1961 | Miskella | 219/553 X |
| 3,244,859 | 4/1966 | Whiteford | 219/348 |
| 3,304,406 | 2/1967 | King | 219/411 |
| 3,355,574 | 11/1967 | Bassett, Jr. | 219/464 |
| 3,407,285 | 10/1968 | Jacobs | 219/456 |
| 3,579,021 | 5/1971 | Kimball | 313/315 X |
| 3,663,798 | 5/1972 | Spiedel et al. | 219/464 |
| 3,714,885 | 2/1973 | Wertheimer et al. | 219/354 X |
| 4,069,437 | 1/1978 | Notelteirs et al. | 313/315 |
| 4,406,944 | 9/1983 | Crain et al. | 219/388 |

FOREIGN PATENT DOCUMENTS

| | | | |
|---|---|---|---|
| 2809131 | 9/1979 | Fed. Rep. of Germany | 219/464 |
| 1032598 | 6/1966 | United Kingdom . | |
| 1133468 | 11/1968 | United Kingdom . | |
| 1273023 | 5/1972 | United Kingdom . | |
| 1282656 | 7/1972 | United Kingdom . | |

*Primary Examiner*—Volodymyr Y. Mayewsky
*Attorney, Agent, or Firm*—Fleit, Jacobson, Cohn & Price

[57] ABSTRACT

Heating apparatus includes a tray having a layer of insulative material disposed therewithin, above which a number of infra-red lamps are supported. The ends of each lamp are provided with a pinch seal having an amp tag connector, which is connected to the respective end of a filament within the lamp, sealed therein. Each pinch seal is enclosed within a ceramic housing and the heating apparatus is mounted beneath a layer of glass ceramic. A heat-conductive stud is intimately disposed between the layer and the pinch seal, via an aperture in the housing, so as to provide a good heat-conductive path from the pinch seal to the relatively cool glass ceramic.

9 Claims, 4 Drawing Figures

HEATING APPARATUS

Figure 1:
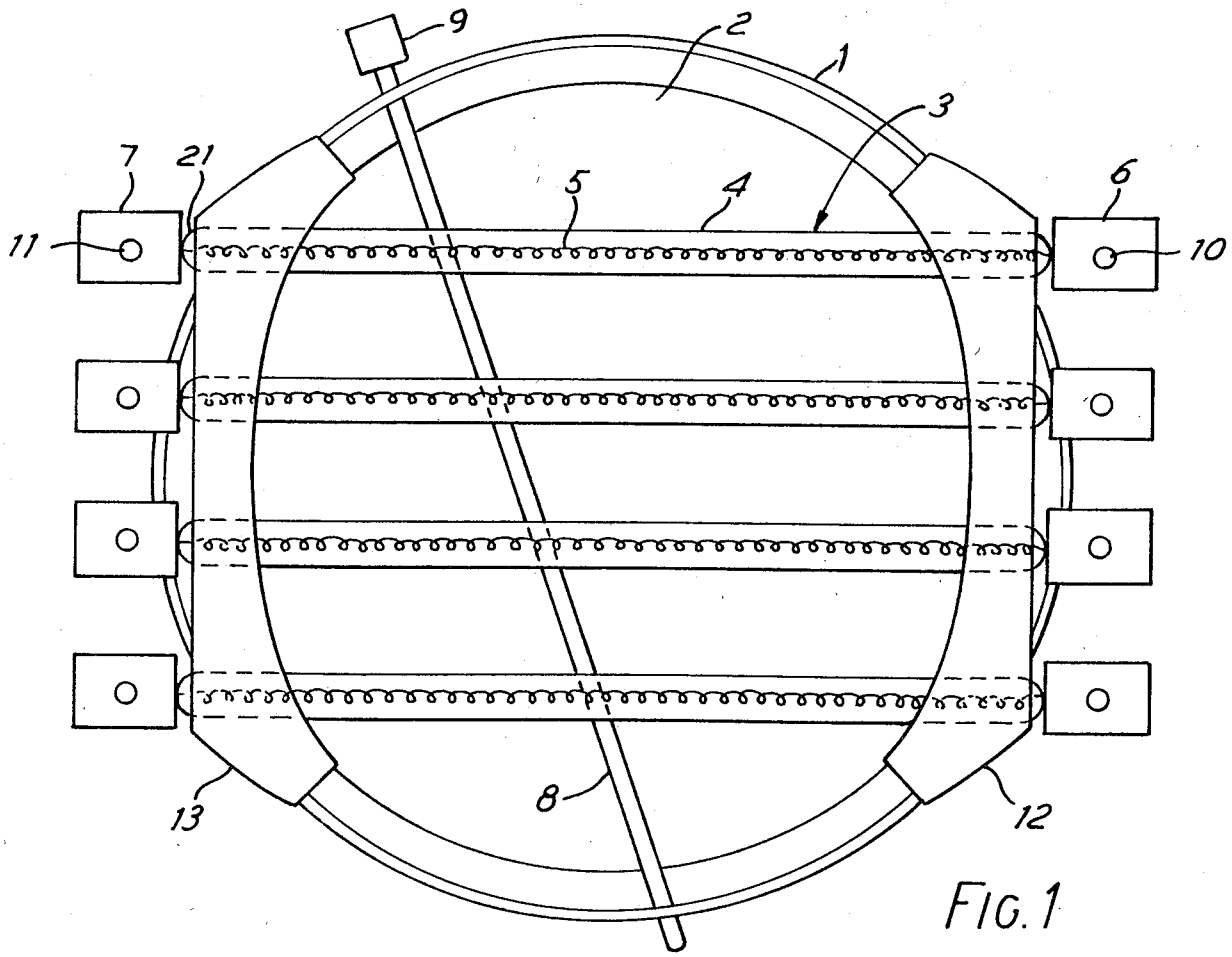

This invention relates to heating apparatus and in particular, though not exclusively, to such apparatus including one or more sources of infra-red radiation.

Heating apparatus of this type is described and claimed in copending British Application No. 8320717 in the name of THORN EMI Domestic Electrical Appliances Limited wherein a number of quartz-halogen infra-red lamps are supported above a shallow metallic tray containing a layer of insulative material, a layer of glass ceramic material being disposed above the lamps as a hot plate for the heating apparatus, thereby forming a cooking hob.

The infra-red lamp is described in more detail and claimed in our copending European Application No. 84301636.1, wherein the lamp comprises a filament supported within a glass tube, each end of the lamp having a pinch seal with an electrical lead connected to the filament sealed into the respective end thereof, the lead being welded to an appropriate electrical connector. The pinch seal is enclosed within a ceramic housing, which is shaped to provide location of the lamp in the correct position on flanges provided either side of the metallic tray, when the lamp is incorporated within the above-mentioned heating apparatus.

However, the highly concentrated heat energy within the apparatus may cause the temperature of the pinch seals to rise above the preferred operating temperature thereof, which is usually at or below approximately 350° C., thereby causing oxidation of the pinch seal and thus reducing the life of the lamp.

This problem of maintaining the temperature of the pinch seal at a substantially safe level to prolong the life of the lamp has been partially overcome by the invention disclosed in a copending British Application No. 8316306, in the name of THORN EMI Domestic Appliances Limited, wherein the preferred embodiment consists of a plate of aluminum, or other suitable heat-conductive material, intimately disposed between the upper surface of the ceramic housing and the under surface of the glass ceramic layer, thereby providing a heat-conductive path from the pinch seals upwardly to the ceramic layer.

However, the ceramic housing may only conduct a limited amount of heat from therewithin to the aluminium plate, so that a substantial amount of heat still remains in the immediate vicinity of the pinch seal.

It is therefore an object of the present invention to provide a substantially improved solution to the above-identified problem.

According to one aspect of the invention, there is provided heating apparatus for mounting beneath a hot plate, said apparatus including at least one infra-red lamp, the or each lamp comprising a filament supported within a generally tubular envelope and having, at each end thereof, a pinch seal with an electrical connection to the respective end of the filament sealed therein, said pinch seal being substantially enclosed within a ceramic housing, said apparatus further including means for conducting heat from said pinch seal in a substantially upward direction towards said hot plate, said means extending into said ceramic housing through an aperture provided therein.

According to a second aspect of the invention, there is provided heating apparatus, as set forth in the immediately preceding paragraph, further including means for urging said first-mentioned means in an upward direction towards said hot plate.

Preferably, the first-mentioned means comprises a stud of suitable heat-conductive material, such as aluminium, which is intimately disposed above the upper surface of the pinch seal and the lower surface of the hot plate, the stud extending through the aperture in the ceramic housing.

It is also preferable that the means for urging the first-mentioned means comprises a resiliently-mounted support member disposed between the lower surface of the pinch seal, via a second aperture in the ceramic housing, and an upwardly-sprung carrier plate which supports the heating apparatus.

Figure 2:
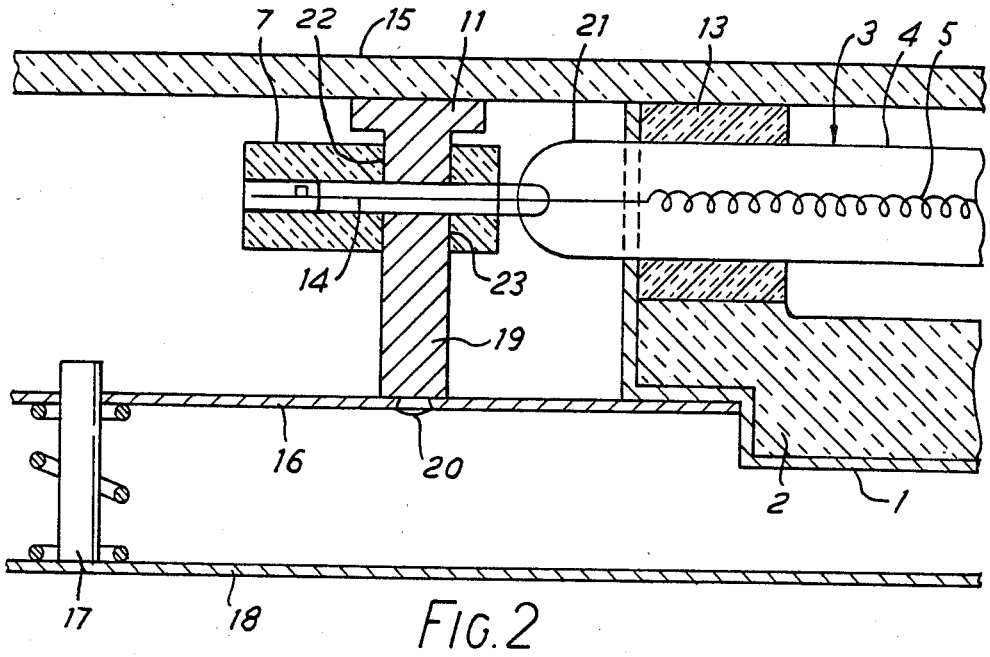
Figure 3:
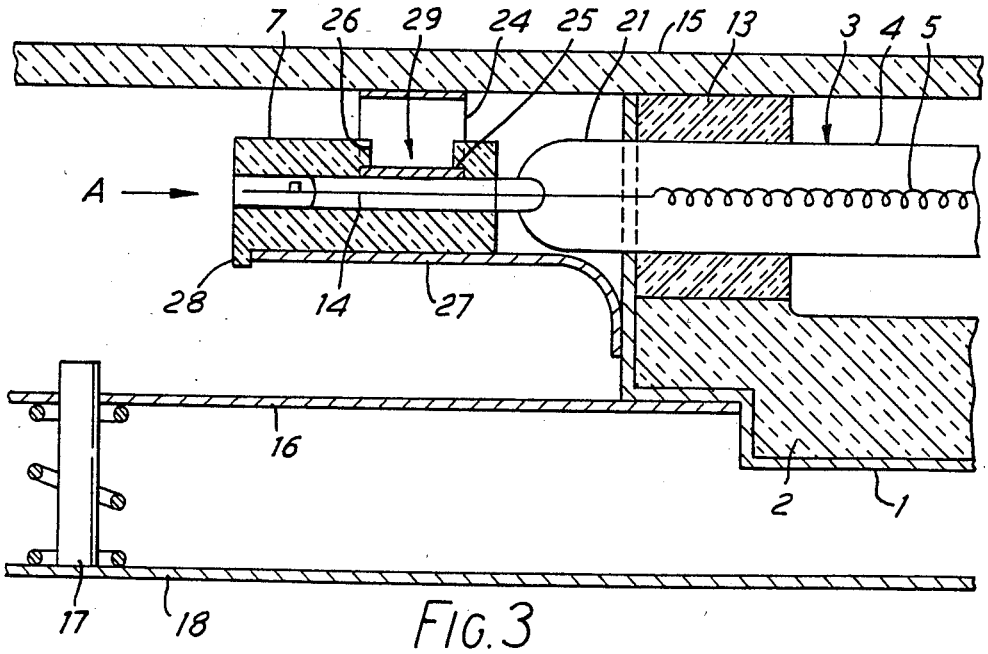
Figure 4:
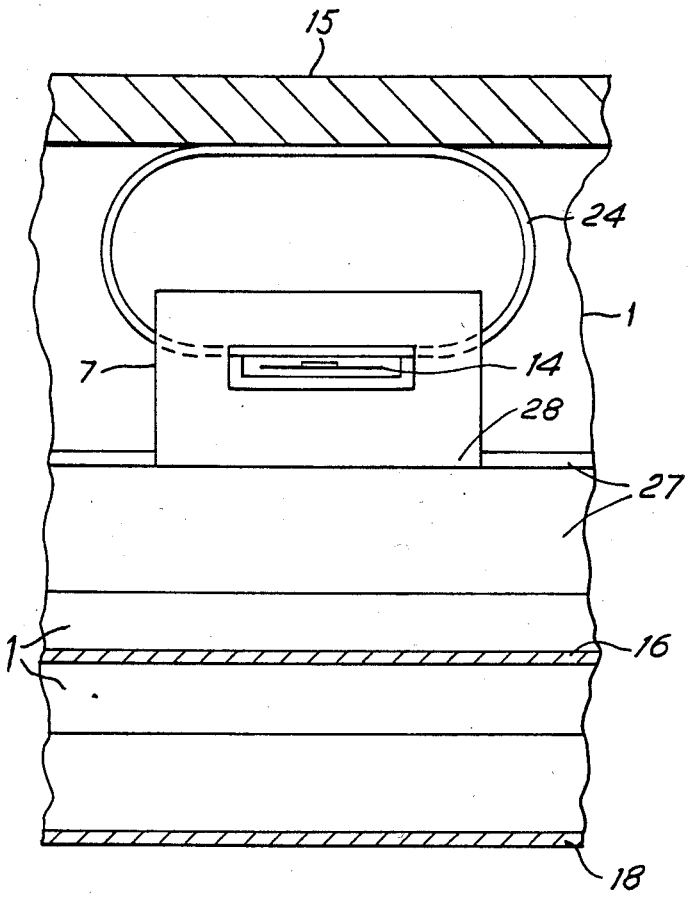

The invention will now be further described by way of example only with reference to the accompanying drawings, wherein:

FIG. 1 shows a plan view of the heating apparatus disposed below the hot plate, FIG. 2 shows an enlarged sectional view of a preferred embodiment of the invention, FIG. 3 shows an enlarged sectional view of a second embodiment, and FIG. 4 shows a view in the direction of arrow A in FIG. 3.

Referring now to FIG. 1, heating apparatus includes a generally circular tray 1, preferably made of metal, which has disposed therewithin a layer 2 of insulative material, preferably a material known as Microtherm. A number of infra-red lamps, one being shown at 3, are disposed above the layer 2 of insulative material and preferably each consist of a quartz-halogenated lamp having a tubular quartz envelope 4, within which a tungsten filament 5 is supported.

Both ends of the lamp 3 are provided with a pinch seal (not shown in FIG. 1) having an amp tag connector, which is connected to the respective end of the filament 5, sealed therein. Electrical leads (also not shown) can then be connected to each amp tag connector, so as to supply power to each infra-red lamp.

Each pinch seal of the lamp 3 is enclosed within a ceramic housing 6 and 7, respectively.

The heating apparatus also preferably includes a thermal limiter 8, disposed between the lamps and the layer 2 of insulative material. The thermal limiter 8 is arranged to operate a microswitch 9, so as to disconnect the power to the lamps when the temperature sensed by the thermal limiter 8 reaches a threshold value.

The heating apparatus may be mounted beneath a hot-plate, eg. a layer of glass ceramic, so as to form a cooking hob.

The heating apparatus and infra-red lamp, so far described, are described in greater detail and claimed in the above-mentioned copending British Application No. 8320717 and European Application No. 84301636.1.

However, to improve substantially the heat conduction away from the pinch seals, so as to prolong the life of the lamps, the present invention provides, in one embodiment, studs, shown at 10 and 11, which extend respectively through an aperture in each of the ceramic housings, 6 and 7, each stud being in thermal contact with the upper surface of the pinch seal within each housing. The top of each stud, 10 and 11, is in contact with the under surface of a layer of glass ceramic, which is disposed above the heating apparatus shown in FIG. 1, to form a hot plate therefor.

In the preferred embodiment of the present invention, the heating apparatus has been slightly modified to that shown in the above-mentioned copending applications, wherein the ends of each lamp are supported on flanges provided either side of the tray 1. In the present embodiment, however, the flanges are replaced by suitably-shaped pieces of insulative material, 12 and 13, through which the ends of each lamp extend and being shaped so that an equal portion 21 of each lamp is exposed, thereby ensuring that substantially equal amounts of heat are dissipated at the ends of all of the lamps incorporated in the heating apparatus.

Referring now to FIG. 2, wherein like parts are labelled with like reference numerals with respect to FIG. 1, there is shown an enlarged sectional view of the end of the lamp 3 including the ceramic housing 7.

It can clearly be seen from FIG. 2 that the stud 11 is intimately disposed between the upper surface of layer 15 of glass ceramic material and the top surface of pinch seal 14 which is enclosed within the housing 7, via an aperture 22 in the housing. The stud 11 is fabricated from any suitable heat-conductive material, preferably aluminium, thus providing a good heat-conductive path from the pinch seal 14 to a region of the glass ceramic layer 15 which is relatively cool.

In accordance with a second aspect of the invention, the embodiment shown in FIG. 2 includes a support member 19, which is mounted to a carrier plate 16 by means of a screw fixing 20 and which is in contact with the under surface of the pinch seal 14, via a second aperture 23 in the ceramic housing 7.

The carrier plate 16, which supports the tray 1, is resiliently mounted to a base plate 18 by a number of pin and spring assemblies, such as at 17, which locate the carrier plate 18 and exert an upward force thereon, thereby urging the heating apparatus upwardly towards the glass ceramic layer 15 so that the top of the tray 1 and the insulative material 13 abuts the underside of the layer 15, thus locating and retaining the infra-red heat generated by the lamps.

It can therefore be envisaged that the pin and spring assembly 17 also urges the support member 19, which is mounted on the carrier plate 16, upwardly, thereby urging the pinch seal 14 into good thermal contact with the stud 11, which in turn is urged into good thermal contact with the glass ceramic layer 15.

To optimise heat conduction, the stud 11 may be cemented into the aperture 22 and/or a heat conducting cement may be provided between the pinch seal and the stud and between the stud and the glass ceramic layer. Support member 19 may also be cemented into aperture 23.

The support member 19 may be formed from a stud of similar shape and size as stud 11 or, alternatively, it may be in the form of a leaf spring, supported by the carrier plate 16 and in contact with the pinch seal 14 via a slot aperture provided in place of circular aperture 23.

The stud 11 and support member 19 may have a cross-section which is circular or any other suitable shape, so as to provide optimum thermal conduction.

It may be preferable to mount all of the support members, which are provided in a common line on each side of the heating apparatus shown in FIG. 1, on to a strip plate which is then mounted onto the carrier plate 16, thereby allowing easier fitting of the apparatus into the base plate 18 to form a cooking hob. A limited amount of heat may be conducted downwardly via the support member 19, but since the carrier plate 16 is preferably metallic and therefore most likely to be much hotter than the region of the ceramic layer in contact with the stud 11, downward heat conduction should be discouraged.

FIGS. 3 and 4 show a second embodiment of the invention, wherein the stud 11 has been replaced by an elliptically-shaped ring 24, made from a suitable heat-conductive material, which may be secured above the pinch seal 14, in thermal contact therewith, by means of slots 25 and 26 provided either side of an aperture 29, which extends across the top of the housing 7.

The advantage of this second embodiment is that the ring 24 provides a measure of extra resilience for the glass ceramic layer 15, which is mounted above, and in contact with, the top portion of the ring 24, and thus aids in reducing manufacturing tolerances.

In FIG. 3, it can be seen that the heating apparatus is provided with a flange 27, as in the above-mentioned British Application No. 8320717, to support the ceramic housing 7, the housing having a locating flange 28 at the end thereof to provide positive location of the housing 7 on the supporting flange 27. The flange 27, which is fixed to the side of the tray 1, is therefore also urged upwardly by the pin and spring assembly 17, thereby urging the ring 24 upwardly into contact with the ceramic layer 15.

FIG. 4 shows a view in the direction of arrow A in FIG. 3, indicating the end face of the housing 7, within which the pinch seal 14 is contained, and illustrating the ring 24 in contact with the ceramic layer 15 and the top of the pinch seal 14.

A heat-conducting cement may, of course, be provided between the contacting surfaces of the pinch seal and the ring and of the ring and the ceramic layer.

It may be clearly envisaged that any suitable combination of the features shown in the two above-identified embodiments may be employed in the heating apparatus.

The portion of the housing 7 which has been cut out to form the aperture 29 may be replaced after insertion of the ring 24 into its position in contact with the pinch seal 14, thereby aiding in maintaining good contact between the ring and the pinch seal.

Instead of incorporating an amp tag connector within the pinch seals of each lamp, it may be preferable to join a high temperature flexible cable directly to an outgoing wire from the pinch seal.

The Figures show a single coil tungsten filament accommodated within each lamp, but it may however be preferable to employ a coiled coil tungsten filament, which generally possesses substantially greater resilience to mechanical shock than single coil filaments.

It can therefore clearly be seen that the present invention provides a substantially improved heat-conductive path from the actual surface of the pinch seal in the ceramic housing in an upward direction, to the relatively cool region of the glass ceramic layer, to that provided by the invention disclosed in the above-mentioned copending British Application No. 8316306.

We claim:

1. Heating apparatus for mounting beneath a glass ceramic layer of a cooking hob, said apparatus including an infra-red lamp and thermally-insulative material below said lamp, said lamp comprising a generally tubular envelope formed from an electrically-insulative and thermally-conductive material, a filament supported within said envelope, first and second pinch seals formed integrally with said envelope and closing respective ends of said envelope, electrical connections to respective ends of said filament sealed within said pinch seals, and first and second ceramic housings substantially enclosing respectively said first and second pinch seals, and an aperture provided in each of said housings, said apparatus being adapted to constrain thermal radiation generated by said lamp to a predetermined region of said glass ceramic layer, said apparatus further including first and second thermally-conductive members extending into said respective ceramic housings through said apertures, said members being located in direct thermal contact with respective upper surfaces of said pinch seals and an undersurface of said glass ceramic layer so as to conduct heat, when mounted, from said pinch seals in a substantially upward direction towards said glass ceramic layer outside of said predetermined region.

2. Heating apparatus as claimed in claim 1 wherein said thermally-conductive members each comprises a generally vertical stud of thermally-conductive material, a lower end of said stud extending into said respective aperture and being located in thermal contact with said upper surface of said respective pinch seal.

3. Heating apparatus as claimed in claim 1 wherein said thermally-conductive members each comprise a ring of thermally-conductive material, a portion of said ring extending into said respective aperture and being located in thermal contact with said upper surface of said respective pinch seal.

4. Heating apparatus as claimed in claim 1 wherein said thermally-conductive member is made from aluminium.

5. A cooking hob comprising a layer of glass ceramic material, a heating apparatus and a resilient support member supporting said apparatus beneath said layer and urging said apparatus upwardly theretowards, said apparatus including an infra-red lamp and thermally-insulative material below said lamp, said lamp comprising a generally tubular envelope formed from an electrically-insulative and thermally-conductive material, a filament supported within said envelope, first and second pinch seals formed integrally with said envelope and closing respective ends of said envelope, electrical connections to respective ends of said filament sealed within said pinch seals, and first and second ceramic housings substantially enclosing respectively said first and second pinch seals, and an aperture provided in each of said housings, said apparatus being adapted to constrain thermal radiation generated by said lamp to a predetermined region of said glass ceramic layer, said apparatus further including first and second thermally-conductive members extending respectively into said ceramic housings through said apertures, and intimately disposed between, and in direct thermal contact with, respective upper surfaces of said pinch seals and an undersurface of said glass ceramic layer, so as to conduct heat, in use, from said pinch seals in a substantially upward direction towards said layer outside of said predetermined region.

6. Heating apparatus as claimed in claim 5 wherein said resilient support member comprises a carrier plate resiliently mounted to a base plate by a plurality of pin and spring assemblies for locating the carrier plate and exerting an upward force thereon.

7. Heating apparatus as claimed in claim 5 wherein further support members for supporting respectively said pinch seals are mounted on said resilient support member, said further support members being in contact respectively with under surfaces of said pinch seals, via further apertures in said ceramic housings.

8. Heating apparatus as claimed in claim 5 wherein said thermally-conductive members each comprise a generally vertical stud of thermally-conductive material, a lower end of said stud extending into said respective aperture and being located in thermal contact with said upper surface of said respective pinch seal, and an upper end of said stud being located in thermal contact with said undersurface of said layer.

9. Heating apparatus as claimed in claim 8 wherein said thermally-conductive members each comprise a ring of thermally-conductive material, a lower portion of said ring extending into said respective aperture and being located in thermal contact with said upper surface of said respective pinch seal, and an upper portion of said ring being located in thermal contact with said undersurface of said layer.

* * * * *